United States Patent [19]

Hartog et al.

[11] Patent Number: 4,624,819

[45] Date of Patent: Nov. 25, 1986

[54] METHOD FOR PRODUCING LAYERS OF DRY FIBRES ON A FORMING SURFACE

[75] Inventors: Stefan M. Hartog, Stockholm; Bernt H. F. Hollmark, Huddinge, both of Sweden

[73] Assignee: Svenska Traforskningsinstitutet, Stockholm, Sweden

[21] Appl. No.: 679,539

[22] Filed: Dec. 7, 1984

[30] Foreign Application Priority Data

Dec. 23, 1983 [SE] Sweden ..... 8307147

[51] Int. Cl.[4] ..... D04H 1/70

[52] U.S. Cl. ..... 264/510; 264/517; 264/518; 264/113; 264/121; 425/80.1; 425/81.1; 425/83.1

[58] Field of Search ..... 264/113, 121, 517, 518, 264/510; 425/81.1, 83.1, 80.1

[56] References Cited

U.S. PATENT DOCUMENTS

| | | | |
|---|---|---|---|
| 2,218,338 | 10/1940 | Manning | 264/518 |
| 2,658,847 | 11/1953 | MacDonald | 264/121 |
| 2,720,005 | 10/1955 | Clark et al. | 264/518 |
| 2,827,668 | 3/1958 | Clark et al. | 264/518 |
| 3,475,791 | 11/1969 | Brewster et al. | 264/518 |
| 3,680,175 | 8/1972 | Kamp et al. | 425/83.1 |
| 3,792,943 | 2/1974 | Helgesson | 425/83.1 |
| 3,857,657 | 12/1974 | Teed | 264/517 |
| 3,939,240 | 2/1976 | Savich | 264/119 |
| 4,164,532 | 8/1979 | Piazza | 264/121 |
| 4,352,649 | 10/1982 | Jacobsen | 425/83.1 |

FOREIGN PATENT DOCUMENTS

| | | | |
|---|---|---|---|
| 212006 | 11/1960 | Austria | 264/121 |
| 1207177 | 2/1960 | France . | |
| 84/02363 | 6/1984 | PCT Int'l Appl. | 264/518 |

*Primary Examiner*—Jan Silbaugh

*Attorney, Agent, or Firm*—Burns, Doane, Swecker & Mathis

[57] ABSTRACT

The invention relates to a method and an apparatus for producing layers of dry fibres and/or particles on a forming surface pervious to air. According to the invention, the material is distributed in air and passed to a forming unit where a turbulence with high intensity is effected in that air is injected through separate nozzles.

18 Claims, 3 Drawing Figures

METHOD FOR PRODUCING LAYERS OF DRY FIBRES ON A FORMING SURFACE

Figure 1:
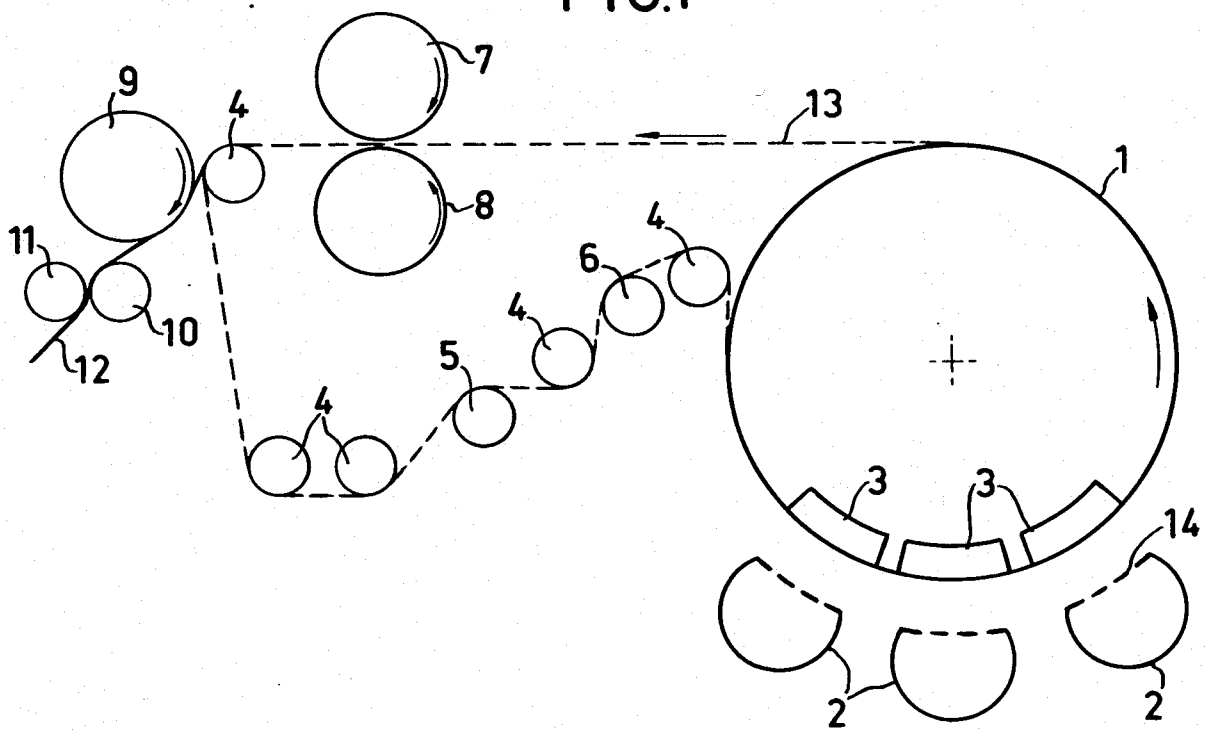

This invention relates to a method and an apparatus for applying one uniform or several uniform layers of fibres and particles on a porous forming surface, which layers among themselves in respect of their structure can be non-uniform and each of the layers can contain different types of fibres or particles. The invention, more precisely, relates to a method and an apparatus for continuously producing a fibre bed consisting of one or several layers of uniform or non-uniform fibre types and particles, which per layer are arranged at random on a wire.

At a previously known machine, a fibrous material, for example fibre pulp, is delivered to a hammer mill, which has one longer curved perforated wall, which partially encloses a space, in which the hammers rotate. The hammer mill is located above an endless wire, which runs over a suction chamber. A fibrous material is supplied into the hammer mill and disintegrated therein, so that loose fibres are formed, which after the passage through the perforated wall flow out against the wire by action of the underpressure produced in the suction chamber. These fibres get deposited on the wire so as to form a fibre layer, which is processed further, for example by adding thereon a binding agent which thereafter is hardened.

At another previously known design, an air flow containing suspending fibres is fed into a fibre distribution installaltion, which comprises a housing part with a perforated plane bottom wall and a mixer with stirrer, which rotates a short distance above, but not in contact with the upper surface of said perforated bottom. This bottom preferably is located immediately above a wire, on the other side of which a suction hammer is located.

During the rotation of the stirrers, the fibres are fed into the housing part and distributed over the wire so as to form a fibre layer thereon, which layer then is processed in the aforementioned way.

At another known design, an air flow containing suspended fibres is fed into a fibre distribution installation, which comprises a housing part with perforated bottom wall, and where the mixer, stirrer, consists of two brush rollers, which rotate a short distance away from the perforated wall. The brush rollers produce the turbulence, which is capable to transport the fibres through the perforated wall to the wire. Beneath the wire a suction chamber with under-pressure is located and, therefore, the fibres passing the perforated sheet are distributed over the wire.

The present invention has the object to produce an apparatus, which has a higher capacity per available forming surface than conventional constructions, is lighter in weight and does not comprise as many movable and space-requiring parts as conventional constructions.

A further object of the invention is to render it possible to build-up a fibre bed, which contains different layers of fibres and particles, which relative to each other have different properties, both from a material-physical and aerodynamic point of view, whereby properties of the fibre bed are obtained which are important for different types of products, for example filters, absorption materials, fibre textiles and reinforcing members in the plastic structural design.

Figure 2:
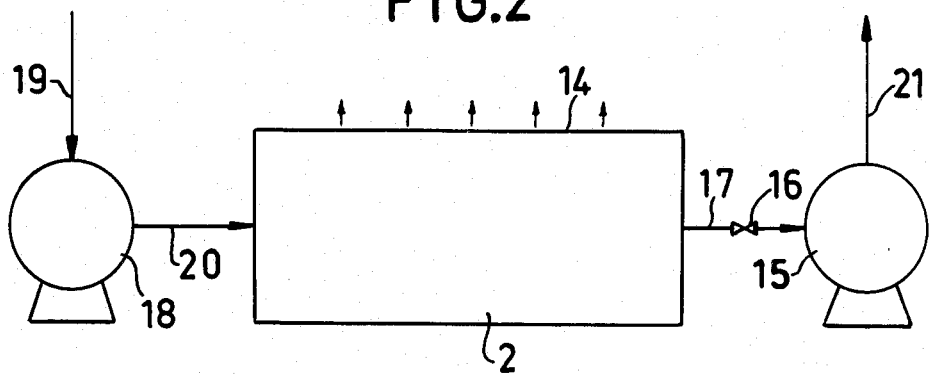
Figure 3:
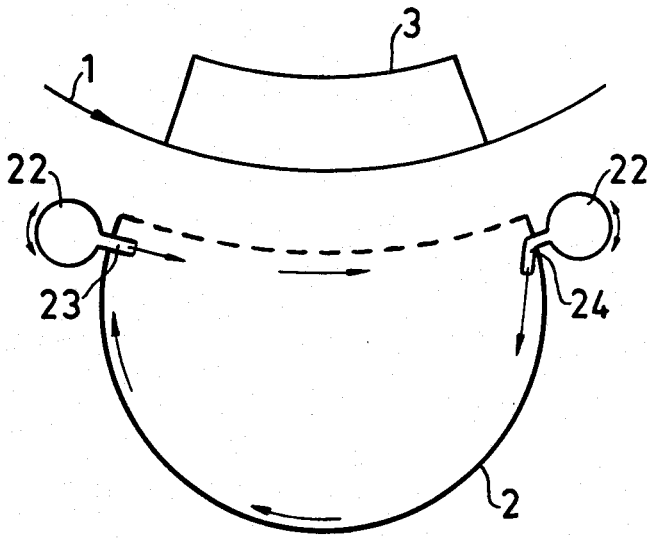

The invention is described in greater detail in the following by way of an embodiment thereof and with reference to the accompanying drawings, in which FIG. 1 shows schematically an arrangement according to the invention, and FIGS. 2 and 3 are a longitudinal and, respectively, cross-section of a forming unit.

At the arrangement shown in FIG. 1, a number of forming units—in the present case three—are located in connection to a forming roll 1, which rotates in the way indicated. Over the roll a wire 13 runs, to which material from the forming units is transferred by the effect of suction from suction boxes 3 located in the interior of the forming roll 1 in a position directly in front of the forming units. The material layer being formed on the wire follows along with the same and passes between two press rolls 7,8, one of which is made of steel and the other one of a suitable rubber material. The wire with the material layer then is passed over a guide roll 4 and further over a so-called pick-off roll where the material web is removed from the wire and passed between two rolls, one embossing roll and one smoothing roll 11, both of which are heated. The material web finally obtained is here designated by 12. The endless wire is passed over a number of rolls, guide rolls 4, stretch roll 5 and alingment roll 6.

The forming unit is shown in greater detail (schematically) in FIGS. 2 and 3. FIG. 2 is a longitudinal section, where the material flow, for example fibres distributed in an air flow, preferably by breaking means (not shown), and/or a particle material by means of a fan 18 with the intake 19 is blown into the forming unit through the conduit 20. The forming unit consists of a housing part 2 and so-called turbulence pipes 22. The housing part is formed as a lying cylinder, the shell surface of which partially has been cut off and is provided with a screen plate 14. The material flow is passed axially through the housing part to an outlet 17 for reject located in the opposed end wall and is discharged by the fan 15 through the conduit 21. The material flow through the unit is controlled by the damper 16.

The mode of operation of the forming unit appears more clearly from FIG. 3. The shell surface of the forming roll is designated by 1, and the associated suction box by 3. The housing part 2 as mentioned above is formed as a lying cylinder, the shell surface of which partially has been replaced by a screen plate 14. On the outside of the housing part, in the longitudinal direction thereof on both sides of the screen plate and in connection thereto, two pipes 22 extend, through which air is injected into the housing part for effecting the desired turbulence and together with the axially supplied material flow to produce a vortex. The pipes 22, the so-called turbulence pipes, are provided for this purpose with nozzles 23,24, which extend into the housing part and can be positioned in the desired direction by turning the pipes 22.

By means of the arrangement shown a high and adjustable fibre concentration can be obtained against the screen plate, and the material is transported through the same by means of the pressure drop produced.

Single fibres are separated from greater aggregates of fibres, and also particles, by means of the pressure drop arising above the screen plate. The intensity of the vortex can be controlled by adjusting the nozzles relative to the inner surface of the forming unit, the hole size of the screen plate and, respectively, the wire mesh and the mutual relation of the nozzles, and the pressure drop above the wire cloth is controlled so that the desired capacity and separation degree are obtained. The forming unit and screen plate are designed so that minimum possible useless turbulence energy is applied. The surface of the screen plate, for example, is polished, and the holes are accurately ground. The appearance of the vortex is obtained in that the nozzles are so positioned relative to each other that secondary undesired turbulence vorticles are inhibited.

The fibres or particles, which do not pass through the screen plate, are transported through the forming unit in axial direction and taken out of the forming unit via a fan 15.

The rate of the fibre/particle dispersion through the forming unit in axial direction can be controlled by means of a damper at the outlet of the forming unit.

The vortex has three functions:

1. To cause the fibre/particle dispersion to move in a circular path whereby a concentration of fibres/particles due to centrifugal and shearing forces is effected at the inside of the shell surface and is transported to the screen plate.

2. To cause the fibres/particles to be separated to single fibres and, respectively, particles by utilizing the shearing forces arising against the screen plate and the open area thereof.

3. To cause the single fibres and particles to be transported through the screen cloth, perforated sheet, by means of the pressure difference arising between the inside and outside of the screen cloth, perforated sheet.

The forming unit is not sensitive to concentration, When a varying amount of fibres is fed into the forming unit where the vortex is firm and the energy content and influx of medium are constant, it is found that the fibre amount passing through the screen plate is substantially constant at varying amounts fed-in.

By connecting in series several forming units with varying screen plate apertures, different functions are obtained, i.e. different layers of particles and/or fibres, from the same medium flow, depending on the aerodynamic character of the particles and fibres.

The forming unit, as mentioned above, operates with over-pressure. This implies that the forming unit can be positioned on any level depending only on how the forming wire runs in relation to the machine stand. A forming unit, for example, can be positioned so that the fibres, particles, are transported to the wire from below, from the side or from above. As a result thereof, a forming system comprising a wire, suction boxes and a plurality of forming units connected in series or in parallel can be built so, that the least possible space is required, and that the forming unit at reconstruction or change in the product direction can be moved in a simple way. It is also possible to position the forming unit against a forming roll of perforated sheet metal, whereby high capacity and flexibility are obtained.

The invention is not restricted to the embodiament shown, but can be varied within the scope of the invention idea.

We claim:

1. A method for manufacturing one or more layers of a substantially dry fibrous and/or particulate material on a forming surface which is pervious to air comprising the steps of (i) distributing the fibrous and/or particulate material into a gas, (ii) leading said material in an adjustable flow and at an adjustable concentration to a housing section of a forming unit having a wall which is in part substantially cylindrical in form and in part comprises a screening device (iii) introducing a stream of the fibrous and/or particulate material into the housing section in an axial direction and causing air or another gas to flow at a high velocity into the housing section through nozzles arranged along the walls of the housing section in a direction substantially transverse to the fibre/particulate stream in order to achieve high intensity turbulence therein, and (iv) causing a portion of said fibrous and/or particulate material in the housing section to be conducted through the screening device in the wall of the housing section and onto the forming surface while causing material not conducted through the screening device to be conducted through an outlet arranged axially of the housing section.

2. Method in accordance with claim 1, wherein the nozzles are supplied with air from two turbulence pipes placed longitudinally in the housing section and adjustable in relation to the housing section.

3. Method in accordance with claim 2, wherein the intensity is regulated by adjustment of the nozzles in relation to each other and to the walls of the housing section.

4. Method in accordance with claim 3, wherein the stream of air from the nozzles is directed partly towards the shell surface of the housing section in order to obtain transport of the material towards a screen device arranged in the wall of the housing section and partly towards the screen device itself in order to increase the shearing forces against the screen device and thereby to prevent blocking and to produce a local drop in pressure across the screen device.

5. Method in accordance with claim 1, wherein the stream of fibres and/or particles is introduced axially into the substantially cylindrical housing section.

6. Method in accordance with claim 5, wherein the flow velocity and thereby the dwell time of the material in the housing section is regulated by means of a valve placed in an outlet.

7. Method in accordance with claim 6, wherein reject material is discharged from the housing section through the outlet.

8. Method in accordance with claim 1, wherein overpressure is maintained in the housing section.

9. Method in accordance with claim 1, wherein a web containing layers of various fibrous and particulate material is formed on the forming surface by arranging two or more forming units in series.

10. Method in accordance with claim 2 whereby a web containing layers of various fibrous and particulate material is formed on the forming surface by arranging two or more forming units in series.

11. Method in accordance with claim 3 whereby a web containing layers of various fibrous and particulate material is formed on the forming surface by arranging two or more forming units in series.

12. Method in accordance with claim 4 whereby a web containing layers of various fibrous and particulate material is formed on the forming surface by arranging two or more forming units in series.

13. Method in accordance with claim 5 whereby a web containing layers of various fibrous and particulate material is formed on the forming surface by arranging two or more forming units in series.

14. Method in accordance with claim 6 whereby a web containing layers of various fibrous and particulate material is formed on the forming surface by arranging two or more forming units in series.

15. Method in accordance with claim 7 whereby a web containing layers of various fibrous and particulate material is formed on the forming surface by arranging two or more forming units in series.

16. Method in accordance with claim 8 whereby a web containing layers of various fibrous and particulate material is formed on the forming surface by arranging two or more units in series.

17. Method in accordance with claim 1, wherein said gas is air.

18. Method in accordance with claim 8, wherein an overpressure of at least 5 mm water column is maintained.

* * * * *